US009970679B2

(12) United States Patent
Noman et al.

(10) Patent No.: US 9,970,679 B2
(45) Date of Patent: May 15, 2018

(54) BURNER ASSEMBLY FOR A HEATING FURNACE

(71) Applicant: Lennox Industries Inc., Richardson, TX (US)

(72) Inventors: Shiblee S. M. Noman, Carrollton, TX (US); John W. Whitesitt, Carrollton, TX (US); Shailesh Manohar, Carrollton, TX (US)

(73) Assignee: LENNOX INDUSTRIES INC., Richardson, TX (US)

( * ) Notice: Subject to any disclaimer, the term of this patent is extended or adjusted under 35 U.S.C. 154(b) by 1215 days.

(21) Appl. No.: 13/718,593

(22) Filed: Dec. 18, 2012

(65) Prior Publication Data

US 2014/0165991 A1 Jun. 19, 2014

(51) Int. Cl.

| | |
|---|---|
| ***F23D 14/02*** | (2006.01) |
| ***F24H 9/00*** | (2006.01) |
| ***B21D 53/02*** | (2006.01) |
| ***F23D 14/58*** | (2006.01) |
| ***F23D 14/60*** | (2006.01) |
| ***F23D 14/64*** | (2006.01) |
| *F24H 3/10* | (2006.01) |

(52) U.S. Cl.

CPC ..... *F24H 9/0068* (2013.01); *B21D 53/02* (2013.01); *F23D 14/58* (2013.01); *F23D 14/60* (2013.01); *F23D 14/64* (2013.01); *F23D 2203/1012* (2013.01); *F23D 2213/00* (2013.01); *F23D 2900/00017* (2013.01); *F24H 3/105* (2013.01); *Y10T 29/49348* (2015.01)

(58) Field of Classification Search

None

See application file for complete search history.

(56) References Cited

U.S. PATENT DOCUMENTS

| | | | | | |
|---|---|---|---|---|---|
| 2,384,510 | A * | 9/1945 | Volkman | F23D 14/10 | 126/116 R |
| 2,572,273 | A * | 10/1951 | Miller | F23D 14/10 | 239/553.3 |
| 2,808,047 | A * | 10/1957 | Jaye | F24H 3/105 | 126/110 R |
| 3,512,910 | A * | 5/1970 | Hein | F23D 14/045 | 239/450 |
| 4,222,526 | A * | 9/1980 | Halstead | F23D 14/26 | 239/556 |
| D264,871 | S * | 6/1982 | Halstead | D23/415 | |
| 4,467,780 | A * | 8/1984 | Ripka | F24H 3/105 | 126/110 R |
| 4,739,746 | A * | 4/1988 | Tomlinson | F24H 3/105 | 126/110 R |
| 4,896,411 | A * | 1/1990 | Dempsey | F24H 3/105 | 29/890.039 |
| 4,940,406 | A * | 7/1990 | Kee | F23D 14/725 | 431/22 |

(Continued)

*Primary Examiner* — Gregory Huson
*Assistant Examiner* — Martha Becton
(74) *Attorney, Agent, or Firm* — Hubbard Johnston, PLLC

(57) ABSTRACT

A burner assembly for a fuel-fired heating furnace. The assembly comprises a burner body having an inlet opening to receive fuel delivered by a fuel control module, and, to receive an ambient source of primary air there-through. The furnace also comprises one or more burner heads connected to a common outlet opening of the burner body to receive a mixture of the fuel and the primary air.

14 Claims, 5 Drawing Sheets

(56) References Cited

U.S. PATENT DOCUMENTS 4,945,890 A * 8/1990 Ripka ..... F24H 9/1836 126/110 R
5,062,409 A * 11/1991 Kamanaka ..... F24H 3/105 126/110 R
5,234,196 A * 8/1993 Harris ..... F23D 14/60 126/39 R
5,346,002 A * 9/1994 Swilik, Jr. ..... F24H 3/105 126/110 R
5,379,751 A * 1/1995 Larsen ..... F24H 3/105 126/110 A
5,437,263 A * 8/1995 Ellingham ..... F24H 3/105 126/110 AA
5,443,364 A * 8/1995 Mistry ..... F04D 29/626 403/326
5,848,887 A * 12/1998 Zabielski ..... F23C 13/00 126/91 A
5,899,686 A * 5/1999 Carbone ..... F23D 14/04 126/91 A
6,027,336 A * 2/2000 Nolte ..... F23D 14/105 431/181
6,960,077 B2 * 11/2005 Buccilli ..... F23D 14/045 239/553
8,591,222 B2 * 11/2013 Sherrow ..... F23C 3/002 126/99 A
9,091,436 B2 * 7/2015 Homma ..... F23D 14/46
9,212,820 B2 * 12/2015 Kowald ..... F23L 1/00
9,261,292 B2 * 2/2016 Sherrow ..... F24H 3/08
2012/0085522 A1 * 4/2012 Haydock ..... F28D 9/0031 165/143
2012/0247444 A1 * 10/2012 Sherrow ..... F24H 9/14 126/116 R
2013/0213378 A1 * 8/2013 Schultz ..... F24H 3/08 126/110 C
2013/0213379 A1 * 8/2013 Schultz ..... F23D 14/02 126/110 C

* cited by examiner

BURNER ASSEMBLY FOR A HEATING FURNACE

TECHNICAL FIELD

This application is directed, in general, to heating furnaces and, more specifically, to a burner assembly for heating furnaces, and, a method of manufacturing thereof.

BACKGROUND

Modern furnaces use burner assemblies with multiple component parts that must be separately manufactured and assembled. Reducing the number component parts needed for the burner assembly, without substantially compromising the efficiency of the furnace, desirably reduces material and assembly costs.

SUMMARY

One embodiment of the disclosure is a burner assembly for a fuel-fired heating furnace. The assembly comprises a burner body having an inlet opening to receive fuel delivered by a fuel control module, and, to receive an ambient source of primary air there-through. The furnace also comprises one or more burner heads connected to a common outlet opening of the burner body to receive a mixture of the fuel and the primary air.

Another embodiment of the disclosure is a fuel-fired heating furnace. The furnace comprises a fuel control module, a heat exchange module having one or more heat exchange tubes and a burner assembly. The assembly includes a burner body having an inlet opening to receive fuel delivered by the fuel control module, and, to receive an ambient source of primary air there-through. The assembly also includes one or more burner heads connected to a common outlet opening of the burner body to receive a mixture of the fuel and the primary air. Each one of the burner heads is coupled to a different one of the heat exchange tubes.

Still another embodiment is a method of manufacturing a burner assembly. The method comprises forming a burner body having an inlet opening to receive fuel delivered by a fuel control module, and, to receive an ambient source of primary air there-through. The method also comprises connecting one or more burner heads to a common outlet opening of the burner body to receive a mixture of the fuel and the primary air.

BRIEF DESCRIPTION

Reference is now made to the following descriptions taken in conjunction with the accompanying drawings, in which.

DETAILED DESCRIPTION

The term, "or," as used herein, refers to a non-exclusive or, unless otherwise indicated. Also, the various embodiments described herein are not necessarily mutually exclusive, as some embodiments can be combined with one or more other embodiments to form new embodiments.

The embodiments of the present disclosure benefit from the recognition that a burner assembly comprising the disclosed new burner body design can eliminate the need for several component parts, thereby substantially reducing the material and assembly costs and time to manufacture the assembly.

One such component part that the disclosed burner assembly eliminates is a fuel manifold module. The term fuel manifold module, as used herein, defined as any conduit (e.g., a pipe) that is attached to the output port of a fuel control module (e.g., a module containing valves to regulate the flow of fuel there-through), and, that delivers fuel only via several fuel outlets (e.g., fuel injector orifices), to the input openings of a set of burner bodies of a fuel-fired heating furnace. Additionally, because there may only be one burner body in the disclosed burner assembly, other component parts, used with the set of burner bodies, e.g., mounting brackets, burner baffle plates, can also be eliminated.

Figure 1:
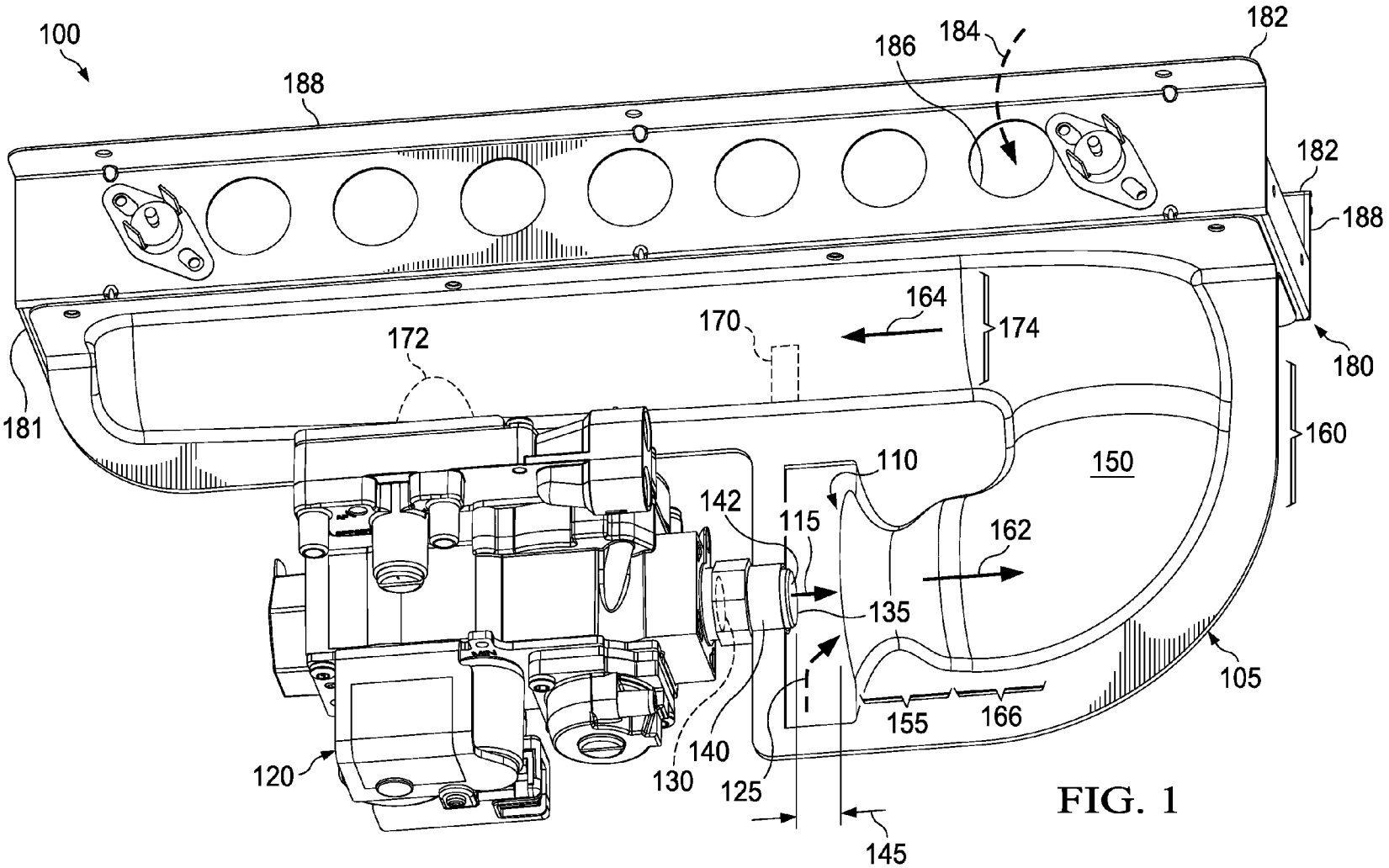
FIG. 1 illustrates an isometric view of an example burner assembly of the disclosure.
Figure 2:
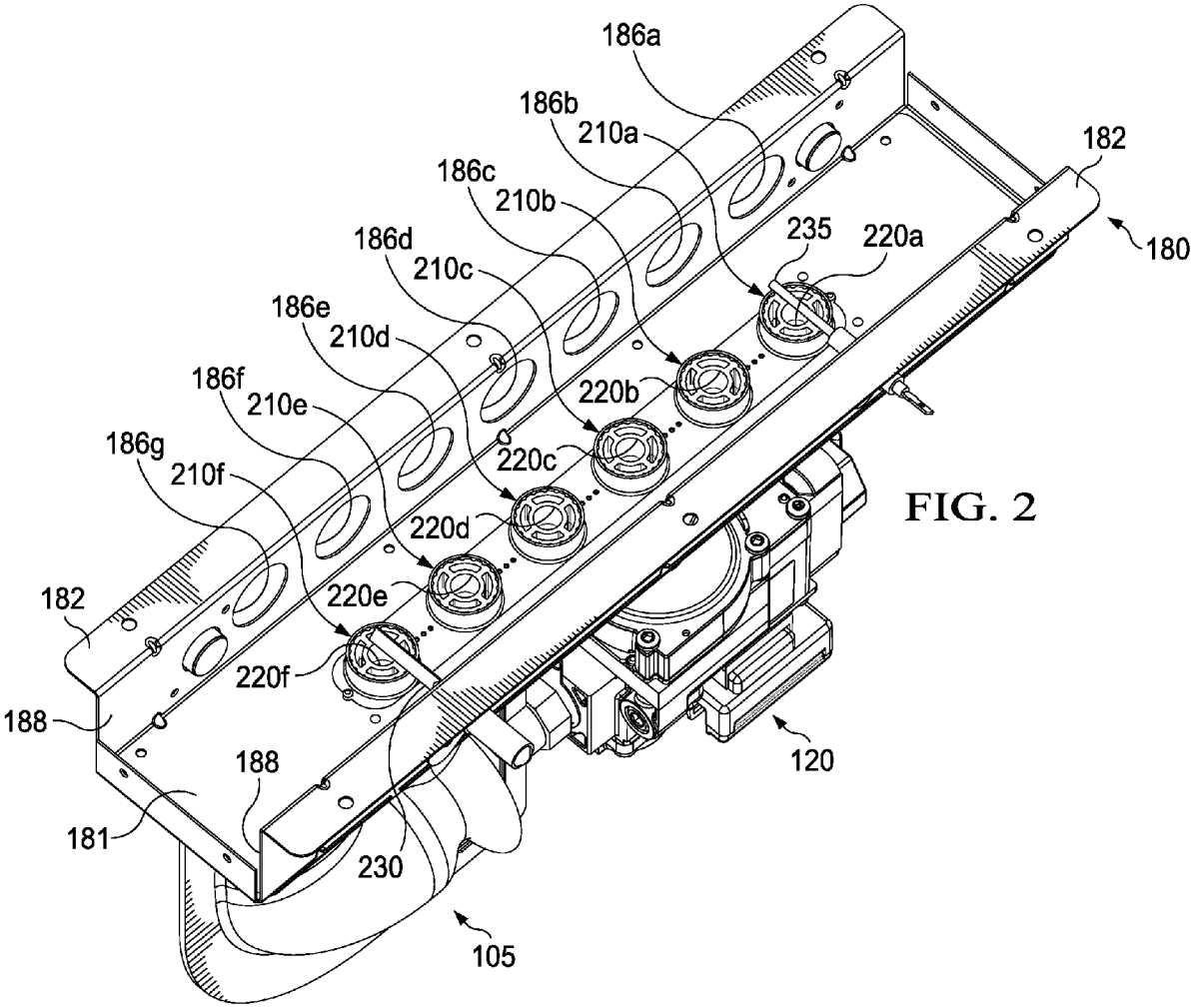
FIG. 2 illustrates an opposing isometric view of the example burner assembly depicted in FIG. 1.
Figure 3:
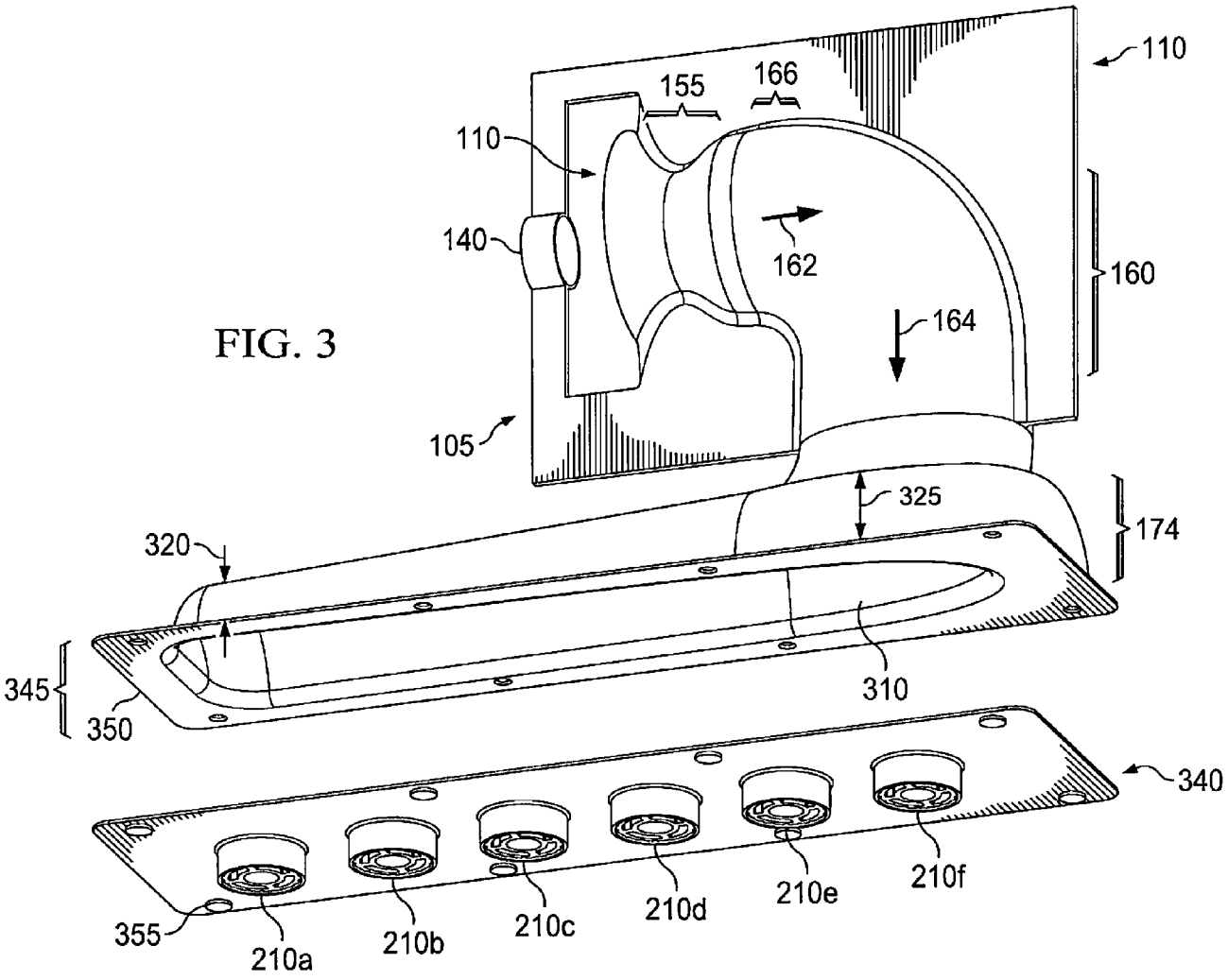
FIG. 3 illustrates an exploded isometric view of another example burner assembly of the disclosure.

One embodiment of the present disclosure is a burner assembly for a fuel-fired heating furnace. FIGS. 1-3 illustrate different isometric views of an example burner assembly 100 of the disclosure. FIG. 2 presents an opposing view of the assembly 100 shown in FIG. 2, and, FIG. 3 shows an exploded isometric view of an alternative embodiment of the burner assembly 100.

As illustrated in FIG. 1, the assembly 100 comprises a burner body 105 having an inlet opening 110 to receive fuel 115 delivered by a fuel control module 120, and, to receive an ambient source of primary air 125 there-through. As illustrated in FIGS. 2 and 3, the assembly 100 further comprises one or more burner heads 210 connected to a common outlet opening 310 of the burner body 105 to receive a mixture of the fuel and the primary air.

The term fuel as used herein includes one or more of gas methane, ethane, propane, butane, pentane or similar combustible hydrocarbon containing fuels, including mixtures thereof. The fuel 115 is fed by the control module 120 to the inlet opening 110 of the burner body 105 while the primary air can be from ambient air 125 in the vicinity of the opening 110, e.g., air drawn into the opening 110 by the combustion of the fuel and air (e.g., primary combustion air) at the one or more burner heads 210.

For the reasons explained above, and as illustrated in FIGS. 1-3, some embodiments of the assembly 100 do not have a fuel manifold assembly. That is, the assembly 100 is a manifold-less burner assembly. For instance, as illustrated for the example embodiments shown in FIGS. 1-3 there is no fuel manifold between the fuel control module 120 and the burner body 105. Moreover, there can be a single burner body 105 and the mixture of fuel 115 and primary air 125 is delivered by the common outlet opening 310 to multiple burner heads 210.

In some cases, the inlet opening 110 of the burner body 105 can receive the fuel 115 directly from a fuel delivery port 130 of the fuel control module 120. In other cases, as illustrated in FIG. 1, the fuel 115 is delivered from an extension tube 135 connected to the fuel delivery port 130 of the fuel control module 120. The extension tube 135 can help ensure that substantially all of the fuel is delivered to the inlet opening 110. In some cases, the extension tube 135 facilitates flexibility in locating the fuel control module 120 in the furnace, since the main body of the fuel control module 120 does not have to be adjacent to the burner body 105.

As illustrated in FIG. 1, in some embodiments, the burner body 105 includes a mounting ring 140 to hold the extension tube 135 and thereby fix the output orifice 142 of the extension tube 135 to a predefined offset distance 145 away from the input opening 110. For instance, fixing the extension tube 135 at the predefined offset distance 145 can help ensure that that substantially all of the fuel 115 is delivered to the inlet opening 110 and at the same time ensure that the tube 135 does not substantial block the inflow of ambient air 125 into the input opening 110. In some cases, the mounting ring 140, by holding the extension tube 135 in place, also helps to fix the location of the control module 120 relative to the burner body 105, or, assist in attaching the control module 120 to the burner body 105.

In some embodiments, as illustrated in FIGS. 1-3, the inlet opening 110 is a common inlet opening, in that this opening 110 is the sole inlet opening for the entry of the mixture of fuel and primary air into the burner body 105. However, other embodiments of the burner body 105 could have more than one inlet opening for the entry of fuel and primary air, e.g., a second opening fed with ambient air 125 and fuel 115 from the one fuel control module 120, or, from a second fuel control module.

As illustrated in FIGS. 1-3, and, further discussed below, various parts of the burner body 105 can be shaped or include features to facilitate one or more of: mixing of the fuel 115 and air 125 coming into the inlet opening 110, preventing flame flashback, (e.g., flashback to the control module 120 through the burner body 105), or, providing the desired distributions of the mixture of fuel 115 and primary air 125 to the individual burner heads 210.

For instance, in some embodiments, as illustrated in FIGS. 1-3, the burner body 105 can include an internal cavity 150 having Venturi 155 near the inlet opening 110. As understood by one skilled in the art, a Venturi refers to a tube section having an internal surface with a tapering constriction in the middle that causes an increase in the velocity of flow of fluid (e.g., the mixture of fuel and primary air) passing through the constriction. Increasing the velocity of flow, in turn, facilitates mixing of the fuel 115 and air 125. Increasing the velocity of flow near the inlet opening 110, as facilitated by the Venturi 155, also helps reduce the back pressure at the opening 110, which in turn helps to prevent flame flash-back. The Venturi 155 can help ensure that the ratio of the volume air to the volume of fuel (e.g., 5:1 or greater or 10:1 or greater in some cases) entering the inlet opening 110 is suitably high enough to deter flame back-flash. However, in other embodiments, the shape of the internal cavity 150 of the body 105 near the inlet opening 110 can simply be a straight-walled opening with no Venturi present.

For instance, in some embodiments, as illustrated in FIGS. 1-3, the inlet opening 110 is located towards one side of the burner body 105. Locating the opening 110 to one side can help to reduce the space occupied by the burner body 105, or, facilitate adapting the burner assembly to fit into existing furnace designs. In some cases locating the opening 110 to one side can facilitate the assembly 100 having a burner body 105 with one or turns 160 therein, while still occupying a minimum amount of space inside of a furnace. However, in other embodiments, the inlet opening 110 could be centrally located in the burner body 105.

For instance, in some embodiments, as illustrated in FIGS. 1-3, the burner body 105 includes an internal cavity 150 having one or more turns 160 that changes a direction 162 of the mixture of fuel and primary air entering through the input opening 110 by at least about 90 degrees. For instance, for the example burner body 105 depicted in FIG. 1, after traveling though the turn 160, the average flow direction 164 of the mixture is about 180 degrees different than the average flow direction 162 of the mixture entering the opening 110. For instance, for the example burner body 105 depicted in FIG. 3, after traveling though the turn 160 the average flow direction 164 of the mixture is about 90 degrees different than the average flow direction 162 of the mixture entering the opening 110.

Including one or turns 160 in the flow pathway of the internal cavity 150 can promote mixing of the fuel 115 and air 125 entering the input opening 160, help prevent flame flash-back to the opening 160, or, reduce the space occupied by the burner body 105 in a furnace. However, in other embodiments, the internal cavity 150 of the burner body 105 could simply be a straight tubular structure with no turns.

As further illustrated in FIGS. 1-3, in some embodiments of the assembly 100 that have a turn 160, there can be straight extension zone 166 between the inlet opening 110 and the turn 160. In some cases, when the burner body 105 has a Venturi 155 the straight extension zone 166 can be between the Venturi 155 and the turn 160. The straight extension zone 166 can help stabilize the flow direction 162 of the mixture of fuel 115 and primary air 125 after traveling through the opening 110 or after traveling through the opening 110 and then the Venturi 155.

In some embodiments of the assembly 100, it is desirable for each one of the burner heads 210 to receive a same volumetric flow rate of the mixture of fuel 115 and primary air 125 regardless of where the burner head 210 is situated relative to the common outlet opening 310. Having a same volumetric flow rate delivered to each burner head 210, in turn, facilitates the formation of a same-sized flame at each of the burner heads 210.

For instance, the internal cavity 150 can include one or more features or be shaped to adjust the desired volumetric flow rate of the mixture to each of the burner heads 210. For example, in some cases, an internal cavity 150 of the burner body 105 includes one or more baffle features 170 therein, the baffle features 170 configured to equalize a volumetric flow rate of the mixture of fuel 115 and primary air 125 passing through the common outlet opening 310 to each of the burner heads 210. For example, in some cases, an internal cavity 150 of the burner body 105 has one or more dimple features 172 on a surface thereof, the dimple features 172 configured to equalize a volumetric flow rate of the mixture of fuel 115 and primary air 125 passing through the common outlet opening 210 to each of the burner heads 210.

For instance, in some cases, a portion 174 of an internal cavity 164 of the burner body 105, which defines the common output opening 310 is shaped to equalize a volumetric flow rate of the mixture of fuel 115 and primary air 125 passing through the common outlet opening 310 to each of the burner heads 210. For example, in some cases, as illustrated in burner heads 210. For example, in some cases, as illustrated in FIG. 3 a depth 320 of the portion 174 that is farthest away from the trip 160 can be shaped to be smaller than the depth 325 of the portion 174 in the vicinity of the turn 160 thereby increasing the pressure of mixture and thereby the increase the velocity of the mixture travelling through the burner head 210*a* that is farthest away from the turn 160, e.g., as compared the velocity of the mixture travelling through the burner heads 210*d*, 210*e* in the vicinity of the turn 160.

In some embodiments of the assembly 100, to facilitate having each one of the burner heads 210 to receive a same volumetric flow rate of the mixture of fuel 115 and primary air 125, a cross-sectional area of openings (e.g., one of more of the openings 220) in one or more of the burning heads (e.g., one or more of burner heads 210*a*-210*f*) can be adjusted to equalize a volumetric flow rate of the mixture of fuel and primary air passing out of each of the burner heads. For example in some embodiments, a volumetric flow rate of the mixture through the openings 220*b*-200*e* of the interior burner heads (e.g., heads 210*b*-210*e*) can be greater than the volumetric flow rate of the mixture through the openings 220*a*-220*e* of the peripheral burner heads (e.g., heads 210*a* and 21 of). In some such cases, the total area of the openings 220*a*, 220*f* of the peripheral burner heads 210*a*, 210*e* can be made relatively larger as compared to the interior burner heads, e.g., to help equalize the volumetric flow rate through each of the burner heads 210. However, in other embodiments, each of the burner heads 210 can be the same size and have the same cross-section area of openings 220 therein.

As further illustrated in FIG. 3, in some embodiments, the one or more burner heads 210 are held in within an insert plate 340 of the assembly 100, wherein the insert plate 340 is configured to cover the common output opening 310. For instance, in some cases, a portion 345 of the burner body 105 can have a planar mounting surface 350 to which the insert plate 340 can be attached, e.g., via connecting structures 355 (e.g., screws, bolts, rivets) or other attaching structures (e.g., welds, clamps etc, . . . ).

As further illustrated in FIGS. 1 and 2, some embodiments of the assembly 160 can further include a patch chamber 180 configured to hold the burner heads 210. In some cases, the insert plate 340 discussed in the context of FIG. 3 can be integrated into patch chamber 180, part of a wall 181 (or in some cases the entire wall) of the patch chamber 340 that opposes and covers the common output opening 310.

The patch chamber 180 can provide a surface mount (e.g., via mounting surfaces 182) to a heat exchange module of a furnace, such that each of the burner heads 210 are situated at the orifice of one heat exchange tube of the heat exchanger. In some cases, the patch chamber 180 can include mounting locations for a flame sensor 230 and a flame igniter 235 located in the chamber 180. In some cases, patch chamber 180 can provide a flame stabilization zone where secondary air 184 can be introduced into the chamber 180, e.g., via openings 186 in one or more of the chamber walls 188. The secondary air 184 can mix with the mixture of fuel 115 and primary air 125 inside the chamber 180.

The size shape or locations of any one or all of the secondary air openings 186 can be adjusted, individually or together, to adjust the amount of secondary air distributed in the vicinity of the burner heads 210. For example, consider again an embodiment of the assembly 100 where a volumetric flow rate of the mixture of fuel and primary air through the openings 220 of the interior burner heads (e.g., heads 210*b*-210*e*) is greater than the volumetric flow rate of the mixture through the openings 220 of the peripheral burner heads (e.g., heads 210*a* and 210*f*). In some such situations, to increase the size of flame produced at the peripheral burner heads, the size of the peripheral secondary air openings (e.g., openings 188*a* and 186*g*) in the vicinity of the peripheral burner heads can be made larger than the size of the interior secondary air openings (e.g., openings 186*b*-186*e*) in the vicinity of the interior burner heads.

Figure 4:
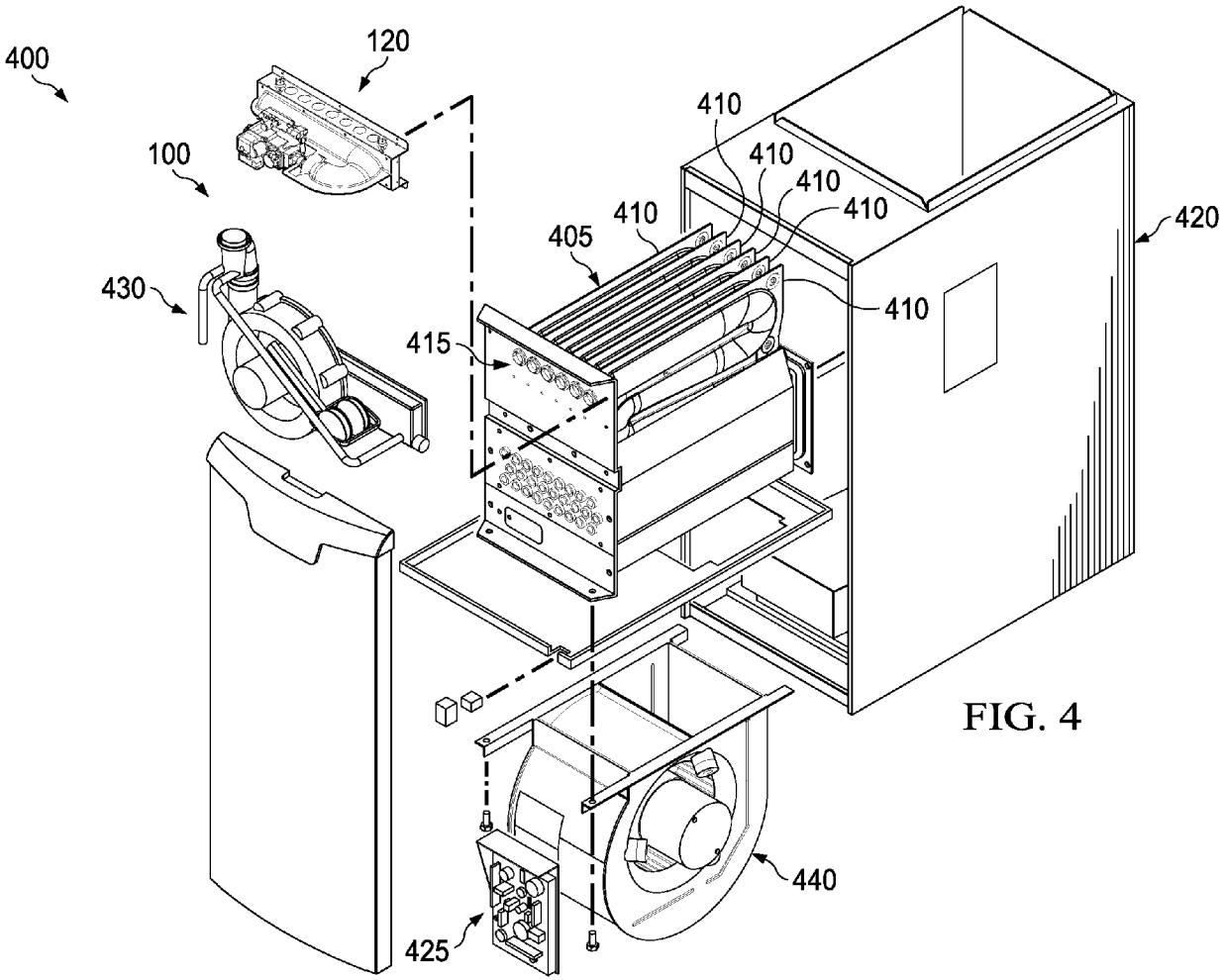
FIG. 4 illustrates an example fuel-fired furnace of the disclosure that includes an embodiment of the burner assembly of the disclosure.

Another embodiment of the disclosure is a fuel-fired heating furnace. FIG. 4 illustrates an example fuel-fired furnace 400 of the disclosure that includes an embodiment of the burner assembly 100 of the disclosure. With continuing reference to FIGS. 1-4 throughout, the furnace 400 depicted comprises a fuel control module 120, a heat exchanger module 405 having one or more heat exchange tubes 410 and a burner assembly 100. The burner assembly 100 can be any of the embodiments of assemblies disclosed herein including any of the assemblies 100 and component parts discussed in the context of FIGS. 1-3.

For instance, the assembly 100 includes a burner body 105 having an inlet opening 110 to receive fuel 115 delivered by the fuel control module 120, and, to receive an ambient source of primary air 125 there-through the opening 110. The assembly 100 includes one or more burner heads 210 connected to a common outlet opening 310 of the burner body 105 to receive a mixture of the fuel 115 and the primary air 125. Each one of the burner heads 210 is coupled to a different one of the heat exchange tubes 410.

In some embodiments, the assembly 100 further includes a patch chamber 180 that holds the burner heads 210 and connects the burner heads 210 to the heat exchange module 410 such that each one of the burner heads 210 are situated at the orifice 415 of different ones of the heat exchange tubes 410. For instance, in some cases, part of each one of the burner heads 210 is situated so as to extend into one of the orifices 415 of one of the heat exchange tubes 410. In some cases an insert plate 340 in a wall 182 of the patch chamber 180 holds the burner heads 210 therein and the insert plate 340 is coupled to the burner body 105 so as to cover the common output opening 310 of the body 105.

In some cases, the patch chamber 180 facilitates the disclosed burner assembly 100 serving as a retrofit replacement of an existing burner box assembly of an existing furnace design such as furnaces deployed residential or commercial settings. For instance, the patch chamber 180 can facilitate using the disclosed assembly 100 within the confines of a furnace cabinet assembly 420 without having to substantially change the size, position, orientation or relative position of the fuel control module 120 and/or heat exchange module 405 in an existing furnace design.

As further illustrated in FIG. 4 the furnace 400 can include additional components that operate in cooperation with the burner assembly 100. For instance, the furnace 400 can include a furnace control module 425 configured to produce a control signal that actuates one or more valves in the fuel control module 120 to thereby cause the fuel control module 120 deliver a regulated amount of the fuel 115 to the inlet opening 110 of the burner body 105.

The furnace control module 425 can also cooperatively control the flame igniter 235 of the assembly 100 and an induction fan assembly 430. For instance the control module 425 can send a control signal to activate the induction fan assembly 430 to thereby draw air through the heat exchange module 410, burner heads 210 and burner body 105, before sending another control signal to activate the flame igniter 235. The furnace control module 425 can also send a control signal to operate an air mover 440 of the furnace 400 (e.g. centrifugal blower), e.g., after the mixture of fuel 115, primary air 125 and secondary air 184 have been ignited and the result flame has stabilized, such as indicated by a temperature reading signal sent by the flame sensor 230 to the module 425.

Figure 5:
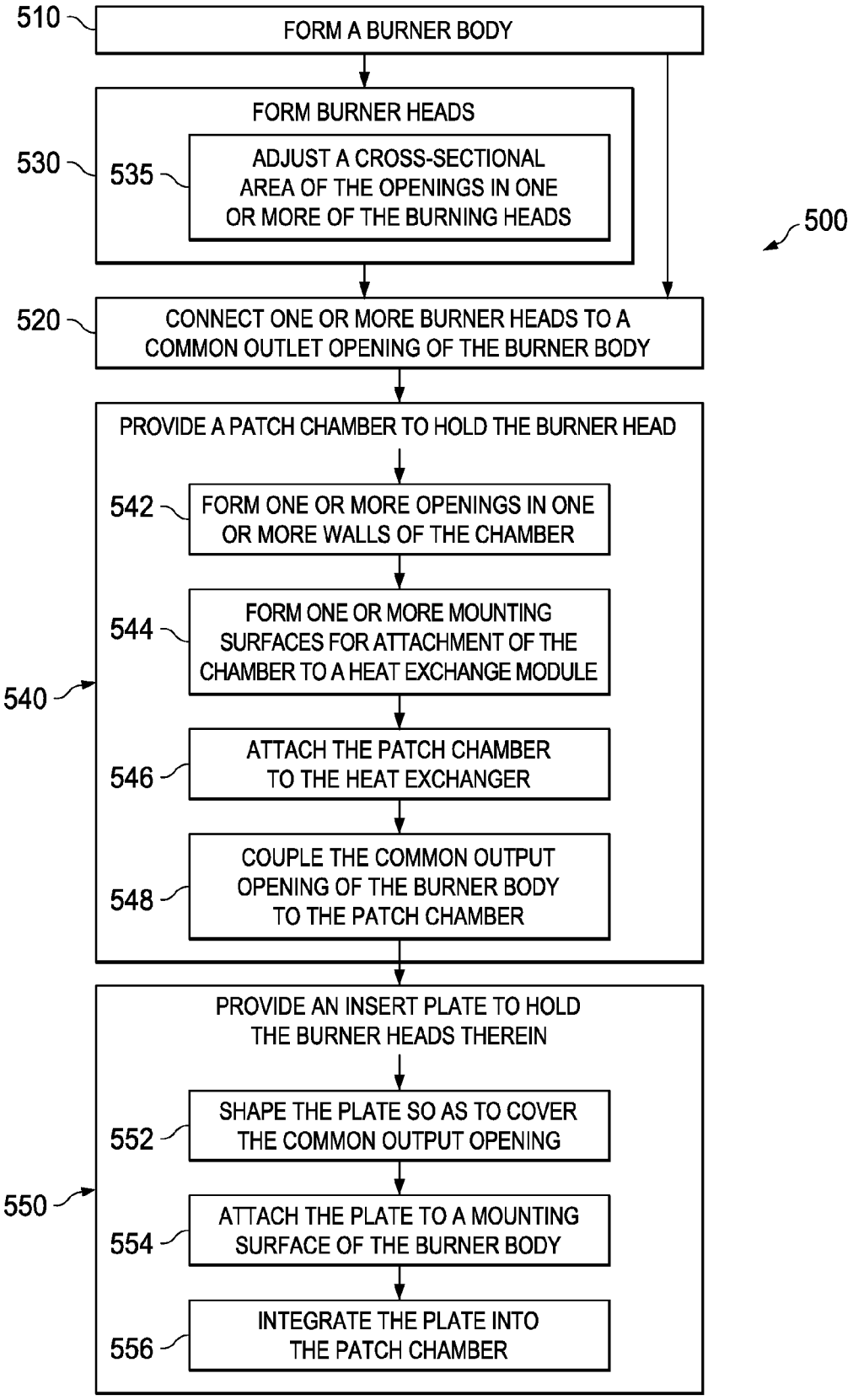
FIG. 5 presents a flow diagram of an example method of manufacturing a burner assembly of the disclosure, such as any of burner assemblies discussed in the context of FIG. 1-4.

Still another embodiment of the disclosure is a method of manufacturing a burner assembly of the disclosure. FIG. 5 presents a flow diagram of an example method 500 of manufacturing a burner assembly of the disclosure, such as any of the burner assemblies 100 discussed in the context of FIGS. 1-4.

With continuing reference to FIGS. 1-4, the method 500 comprises a step 510 of forming a burner body 105 having an inlet opening 110 to receive fuel 115 delivered by a fuel control module 120, and, to receive an ambient source of primary air 125 there-through. The method 500 also comprises a step 520 of connecting one or more burner heads 210 to a common outlet opening 310 of the burner body 105 to receive a mixture of the fuel 115 and the primary air 125.

In some embodiments, the step 510 of forming the burner body 105, can include one or more of: forming internal cavity 150 having Venturi 155 near the inlet opening 110; forming the internal cavity 150 with one or more turns 160; forming one or more baffle features 170 or dimple features 172 in the cavity 150. Additionally or alternatively, forming the body 105 in step 510 can include forming a portion 174 of the internal cavity 150 to define the shape of the common output opening 310 so as to equalize a volumetric flow rate of the mixture of fuel 115 and primary air 125 passing through the opening 310 to each of the burner heads 210. One skilled in the art would be familiar with procedures to form the body 105, as part of step 510, so that the internal cavity 150 includes one or all of these characteristics. Non-limiting examples include: die-cast molding, injection molding, welding, stamping or machining metal starting materials, such as aluminum or aluminum alloys.

Some embodiments of the method 500 can further include a step 530 of forming the burner heads 210. In some cases forming the burner heads in step 530 includes adjusting, in step 535, a cross-sectional area of the openings 220 in one or more of the burning heads 210 so as to equalize a volumetric flow rate of the mixture of fuel 115 and primary air 125 passing out of each of the burner heads 210.

Some embodiments of the method 500 can further include a step 540 of providing a patch chamber 180 configured to hold the burner heads 210. In some cases, providing the patch chamber 180 (step 540) includes a step 542 of forming one or more openings 186 (e.g., via drilling, stamping or other techniques familiar to those skilled in the art) in one or more walls 188 of the chamber 180. Forming the opening 186 (step 542) can include individual adjustments (e.g., size, shape and location) of each opening 186 so as to adjust the amounts of secondary air 184 there-through to mix with the mixture of fuel 115 and primary air 125 passing out of each of the burner heads 210 in the chamber 180. In some cases, providing the patch chamber 180 (step 540) includes a step 544 of forming one or more mounting surfaces 182 for attachment of the chamber 180 to the heat exchange module 405. For instance, a portion of one or more of the walls 188 can be bent as part of step 544, to form the mounting surfaces 182. In some cases, providing the patch chamber 180 (step 540) includes a step 546 of attaching the patch chamber 180 to the heat exchanger 405 such that the burner heads are located at the and a step 548 of attaching the burner body to the patch chamber 180 such that the burner heads 210 are situated at the orifices 415 of different ones of the heat exchange tubes 410. In some cases, providing the patch chamber 180 (step 540) includes a step 548 of coupling the common output opening 310 of the burner body 105 to the patch chamber 180 so that the mixture of fuel 115 and primary air 125 is delivered to the burner heads 210 that are held by the chamber 180.

Some embodiments of the method 500 can further include a step 550 of providing an insert plate 340 configured to hold the burner heads 210 therein. In some cases, part of providing the plate 340 in step 550 includes a step 552 of shaping the plate (e.g., via molding or cutting) so as to cover the common output opening 310. In some cases, part of providing the plate 340, in step 550, includes a step 554 of attaching the plate 340 to a mounting surface 350 of the burner body 105. In some embodiments, in step 556, the insert 340 is integrated into the patch chamber 180, e.g., the plate 340 is part of a wall 181, or, in some cases the entire wall, of the patch chamber 340 that opposes and covers the common output opening 310.

Those skilled in the art to which this application relates will appreciate that other and further additions, deletions, substitutions and modifications may be made to the described embodiments.

What is claimed is:

1. A burner assembly for a fuel-fired heating furnace, comprising:

a burner body having an inlet opening to receive fuel delivered by a fuel control module, and, to receive an ambient source of primary air there-through, the burner body comprising a common outlet opening configured to receive a mixture of the fuel and the primary air, the common outlet opening comprising an open face, a back edge distal to the face, and two lateral edges, wherein the burner body includes an internal cavity having one or more turns that changes a direction of the entire mixture of fuel and air entering through the input opening by at least about 90 degrees, and wherein the inlet opening is located towards one of the lateral edges;

a patch chamber configured to attach to the burner body and comprising a plurality of chamber walls extending away from the burner body, the plurality of chamber walls comprising a plurality of openings therein to allow secondary air there-through to mix with the mixture of fuel and primary air, wherein the patch chamber comprises a surface mount configured to engage a heat exchange module of a furnace; and an insert plate configured to cover the common outlet opening and to fit within the patch chamber and comprising one or more burner heads extending outward from the insert plate.

2. The assembly of claim 1, wherein the inlet opening receives the fuel from an extension tube connected to a fuel delivery port of the fuel control module.

3. The assembly of claim 2, wherein the burner body include a mounting ring to hold the extension tube and thereby fix an output orifice of the extension tube to a predefined offset distance from the input opening.

4. The burner assembly of claim 1, wherein the burner body includes an internal cavity having Venturi near the inlet opening.

5. The burner assembly of claim 1, wherein the burner body comprises an internal cavity and one or more baffle features on an edge of the internal cavity distal to the insert plate.

6. The burner assembly of claim 1, wherein the burner body comprises an internal cavity and one or more dimple features on an edge of the internal cavity distal to the insert plate.

7. The burner assembly of claim 1, wherein the burner body comprises an internal cavity and the internal cavity has a depth, and wherein the depth is smaller at a location farthest away from a turn within the burner body than at a location in the vicinity of the turn.

8. The burner assembly of claim 1, wherein a cross-sectional area of openings in one or more of the burning heads can be adjusted to equalize a volumetric flow rate of the mixture of fuel and primary air passing out of each of the burner heads.

9. A fuel-fired heating furnace, comprising:

the burner assembly of claim 1, a fuel control module; and a heat exchange module having one or more heat exchange tubes, wherein each one of the burner heads is coupled to a different one of the heat exchange tubes.

10. The furnace of claim 9, wherein the patch chamber connects the burner heads to the heat exchange module such that each one of the burner heads are situated at the orifice of different ones of the heat exchange tubes.

11. The furnace of claim 10, wherein the insert plate of the patch chamber is coupled to the burner body so as to cover the common output opening.

12. The furnace of claim 9, further including a furnace control module configured to a control signal that actuates one or more valves in the fuel control module to thereby cause the fuel control module deliver a regulated amount of the fuel to inlet opening of the burner body.

13. A method of manufacturing a burner assembly, comprising:

forming a burner body having an inlet opening to receive fuel delivered by a fuel control module, and, to receive an ambient source of primary air there-through; and connecting one or more burner heads to a common outlet opening of the burner body to receive a mixture of the fuel and the primary air;

the common outlet opening comprising an open face, a back edge distal to the face, and two lateral edges, wherein the burner body includes an internal cavity having one or more turns that changes a direction of the entire mixture of fuel and air entering through the input opening by at least about 90 degrees, and wherein the inlet opening is located towards one of the lateral edges;

forming a patch chamber configured to attach to the burner body and comprising a plurality of chamber walls extending away from the burner body, the plurality of chamber walls comprising a plurality of openings therein to allow secondary air there-through to mix with the mixture of fuel and primary air, wherein the patch chamber comprises a surface mount configured to engage a heat exchange module of a furnace; and forming an insert plate configured to cover the common outlet opening and to fit within the patch chamber and comprising one or more burner heads extending outward from the insert plate.

14. The method of claim 13, further including mounting the patch chamber to the heat exchange module and attaching the burner body to the patch chamber.

* * * * *